US006164372A

United States Patent [19]

Persson

[11] Patent Number: 6,164,372

[45] Date of Patent: Dec. 26, 2000

[54] HEAT EXCHANGER

[75] Inventor: Lars Persson, Kustvägen, Sweden

[73] Assignee: IP Compact AB, Malmo, Sweden

[21] Appl. No.: 09/387,134

[22] Filed: Aug. 31, 1999

[30] Foreign Application Priority Data

Sep. 1, 1998 [SE] Sweden ..... 9802972

[51] Int. Cl.[7] ..... F28F 3/08

[52] U.S. Cl. ..... 165/167; 165/148

[58] Field of Search ..... 165/148, 166, 165/167, 153, 916

[56] References Cited

U.S. PATENT DOCUMENTS

| | | | |
|---|---|---|---|
| 2,288,061 | 6/1942 | Arnold . | |
| 4,128,684 | 12/1978 | Bomio et al. . | |
| 4,475,589 | 10/1984 | Mizuno et al. | 165/166 |
| 5,069,276 | 12/1991 | Seidel | 165/166 |
| 5,088,552 | 2/1992 | Raunio . | |
| 5,343,936 | 9/1994 | Beatenbough et al. | 165/41 |
| 5,467,817 | 11/1995 | Schwald | 165/167 |
| 6,016,865 | 1/2000 | Blomgren | 165/148 |

FOREIGN PATENT DOCUMENTS

| | | | |
|---|---|---|---|
| 1 930 815 | 4/1970 | Germany . | |
| 1 751 464 | 7/1971 | Germany . | |
| 5-196386 | 8/1993 | Japan | 165/167 |
| 588 672 | 6/1977 | Switzerland . | |
| 1 455 696 | 11/1976 | United Kingdom . | |
| 2005398 | 4/1979 | United Kingdom | 165/167 |

*Primary Examiner*—Allen Flanigan
*Attorney, Agent, or Firm*—McCormick, Paulding & Huber LLP

[57] ABSTRACT

The present invention relates to a plate heat exchanger of cross-flow type for heat exchange between different media of which at one is a gas and the other a fluid, wherein the plate heat exchanger comprises plates (8*a,* 8*b*) with elongated and in various alternating directions protruding corrugating ridges (15) and wherein the plate heat exchanger has through-flow gaps for a gas and through-flow gaps for a fluid. The plates (8*a,* 8*b*) are provided with edge portions and end walls which on different plates (8*a,* 8*b*) are positioned in different directions relative to the corrugating ridges (15) of the same plate (8*a,* 8*b* respectively). The edge portions and end walls of different plates (8*a,* 8*b*) are joined together by means of soldering.

28 Claims, 7 Drawing Sheets

HEAT EXCHANGER

The present invention relates to a plate heat exchanger of cross-flow type for heat exchange between different media of which one is a gas and the other fluid, wherein the plate heat exchanger comprises plates with elongated and in various alternating directions protruding corrugating ridges, wherein the plate heat exchanger has through-flow gaps for a gas and through-flow gaps for a fluid, wherein the through-flow gaps extend crosswise relative to each other through the plate heat exchanger such that said gas and fluid flow crosswise relative to each other through said plate heat exchanger, wherein each plate defines a partition wall between two different through-flow gaps for gas and fluid respectively such that heat transfer between said media gas and fluid respectively occurs through said plate, wherein the corrugating ridges are situated between two planes, wherein each plate has two opposing edge portions which are provided in one plane and two other opposing edge portions which are provided with fluid transfer openings and which are provides in the other plane, wherein the fluid transfer openings of the two other edge portions are provided for the transfer of fluid between fluid transfer chambers which are formed by the plates and through which fluid is transferred to and from the through-flow gaps for fluid and wherein the corrugating ridges are located inclined or obliquely relative to said edge portions.

Plate heat exchangers of the abovementioned cross-flow type are previously known from e.g. U.S. Pat. Nos. 2,288,061, 5,467,817 and CH, A, 588 672. At these heat exchangers the plates are not of such a configuration and they are not joined together such that they form a plate heat exchanger which is cheap, effective, tight and rigid.

The object of the present invention is to improve a plate heat exchanger of the type defined above and this is arrived at according to the invention by providing the plate heat exchanger substantially with the characterizing features of subsequent claim 1.

The plate heat exchanger according to the invention has, inter alia, the following advantages:

1) since the corrugating ridges cross each other and are inclined relative to the edge portions, a strong turbulence is generated in the through-flow gaps, which is advantageous,
2) since the inlet and outlet gaps, when the plates are assembled, have substantially the same height as the through-flow gaps, restriction of the flow at the inlets and outlets of the through-flow gaps is avoided,
3) since the corrugating ridges and the end walls in different plates are positioned in different directions relative to each other, the plates together could form a simple and rigid construction,
4) since the edge portions the corrugating ridges and the end walls are joined together by means of soldering the production time could be reduced and excellent tightness and rigidity could be obtained.

The invention will be further described below with reference to the accompanying drawings, in which FIG. 1 is a perspective view of a plate heat exchanger according to the invention;

Figure 1:
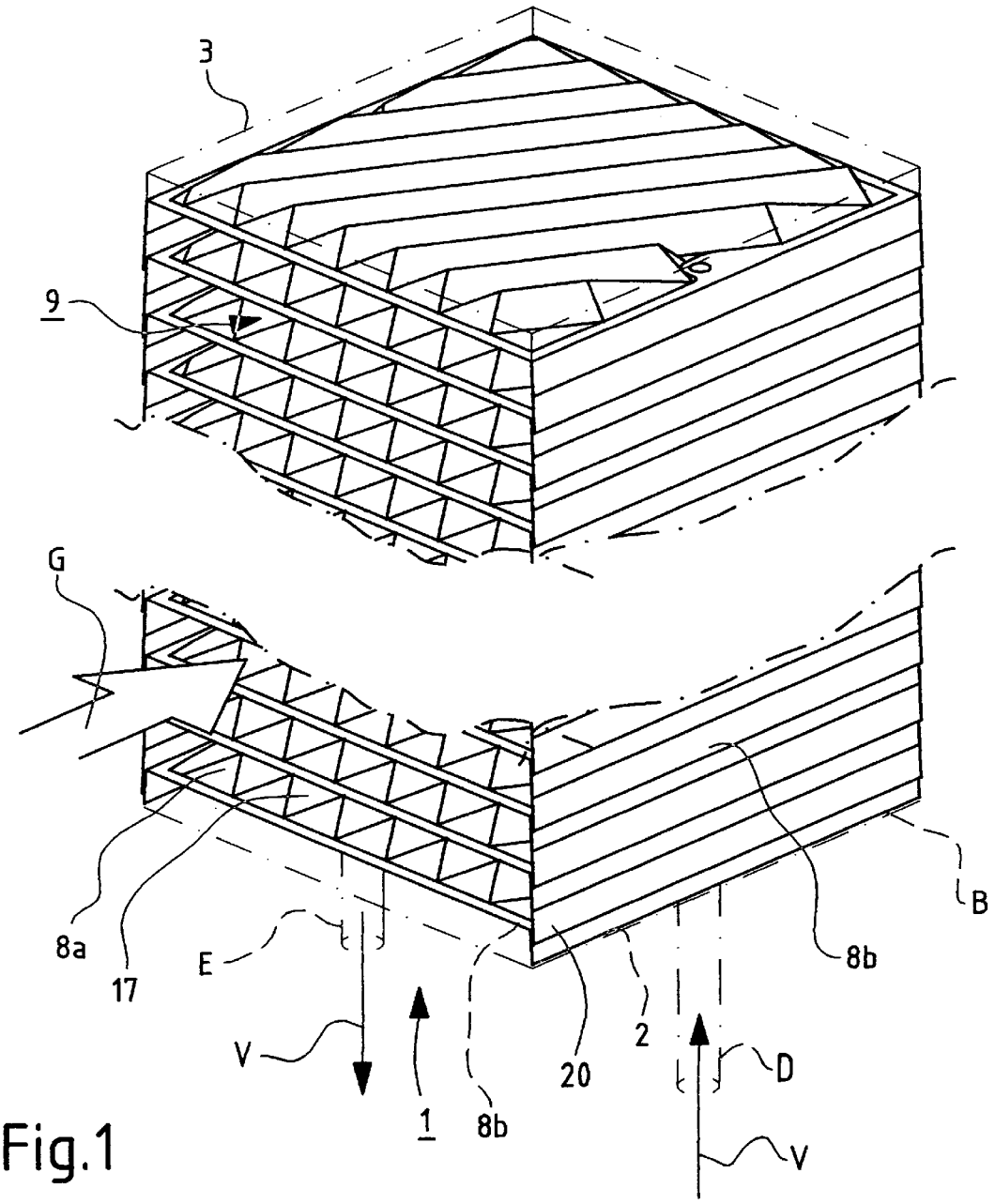
Figure 2:
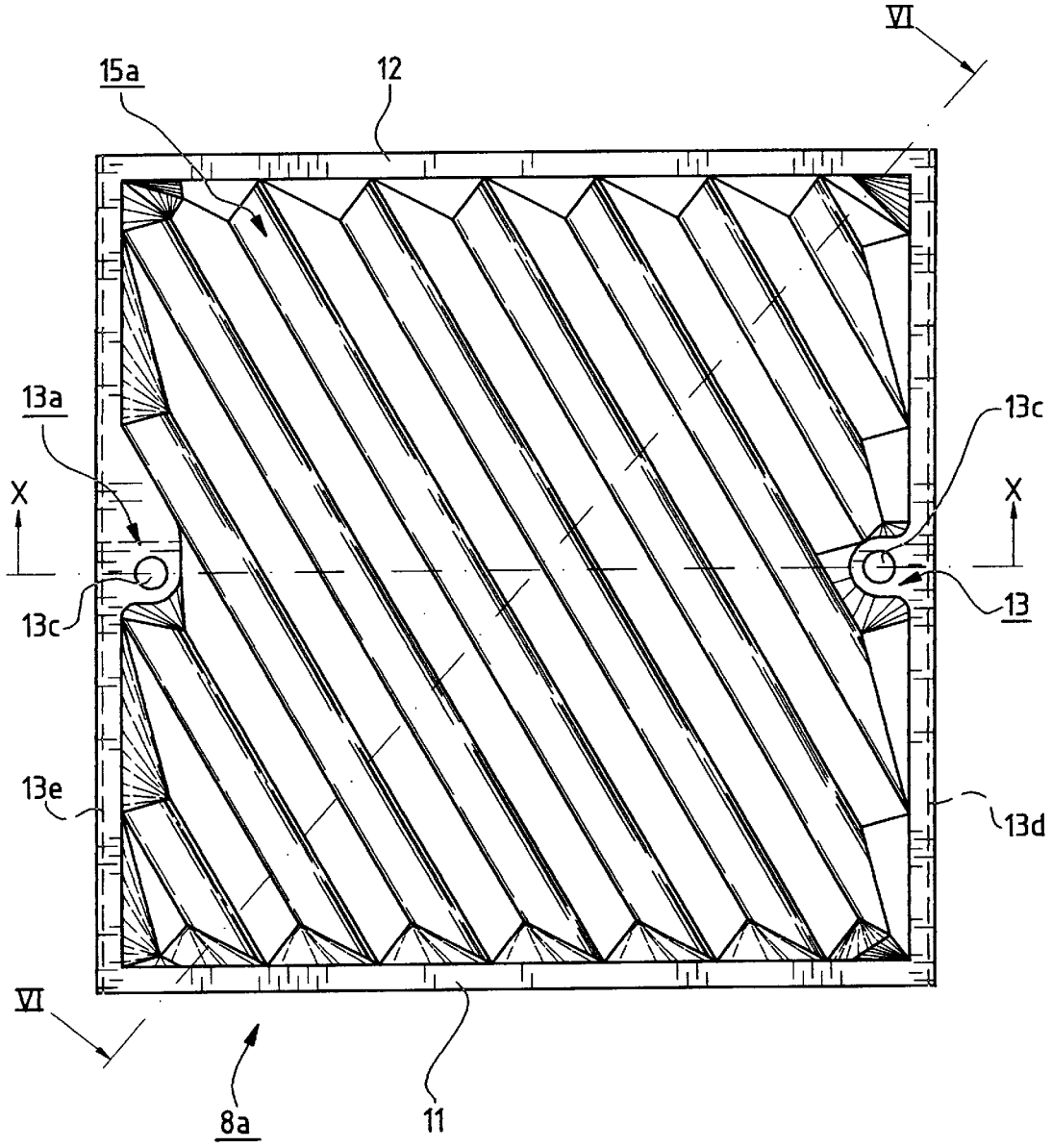
FIG. 2 is a plan view of a first plate forming part of the plate heat exchanger of FIG. 1.
Figure 3:
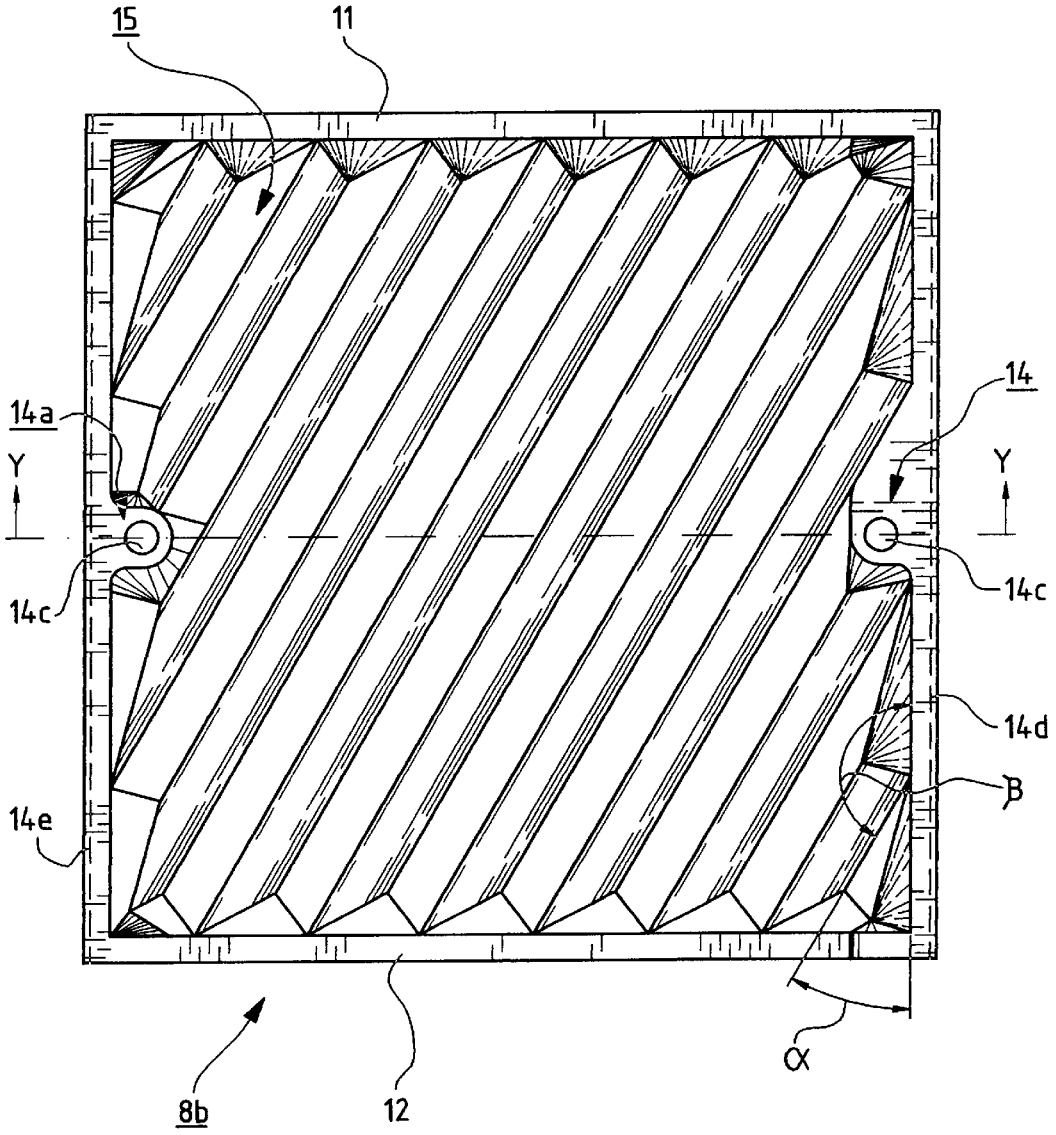
FIG. 3 is a plan view of a second plate forming part of the plate heat exchanger of FIG. 1.
Figure 4:
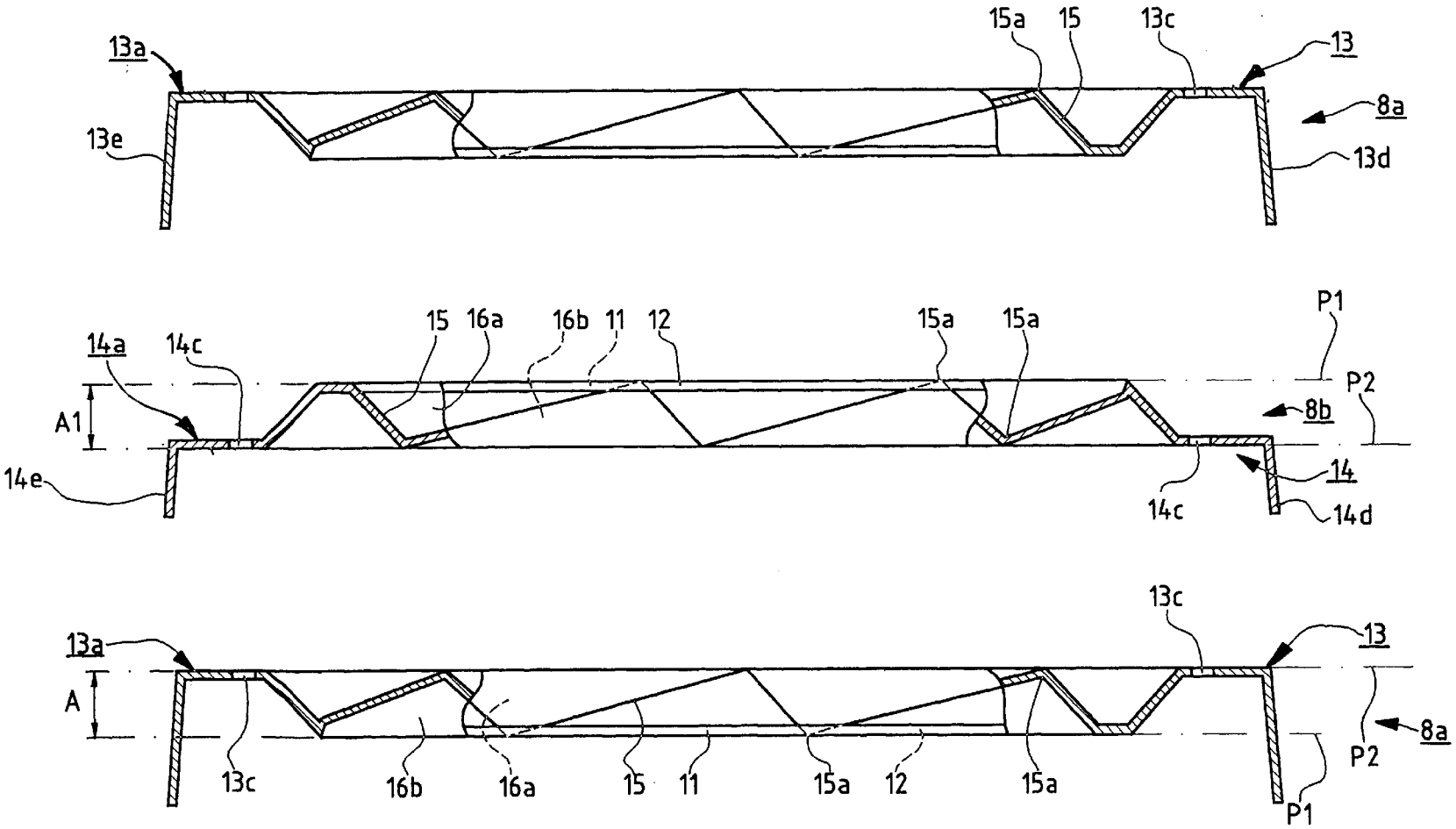
FIG. 4 shows sections X—X and Y—Y of plates forming part of the plate heat exchanger of FIGS. 2 and 3.
Figure 5:
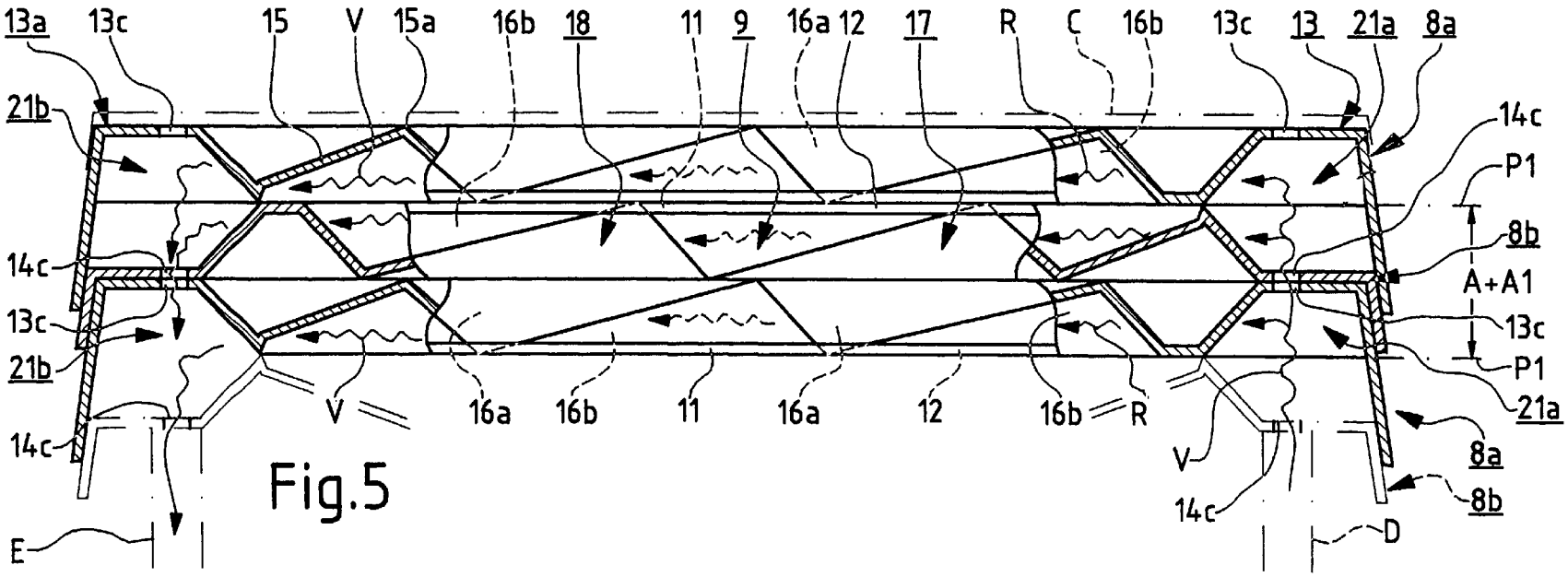
FIG. 5 shows three plates of FIG. 4 attached to each other.
Figure 6:
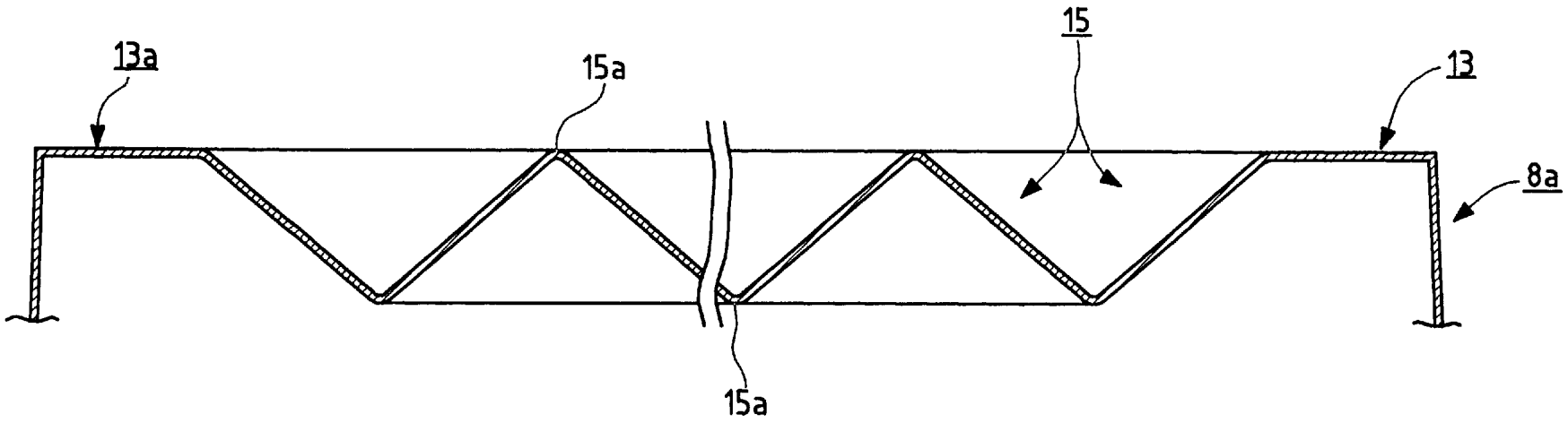
FIG. 6 is a section through the plate of FIG. 2.
Figure 7:
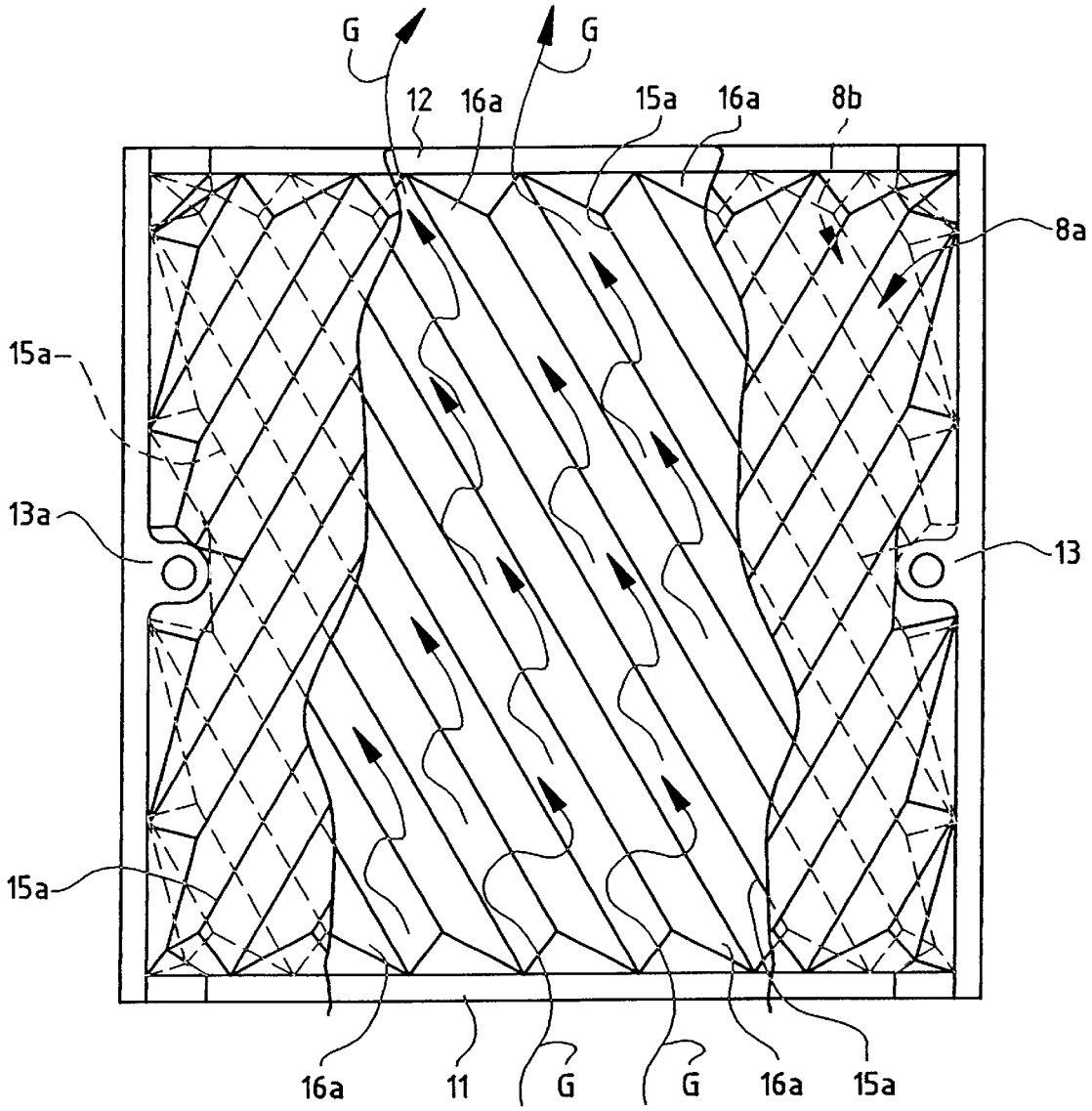
FIG. 7 illustrates schematically flows of medium through through-flow passages between two adjacent plates in the plate heat exchanger of FIG. 1.

The plate heat exchanger illustrated in the drawings is of the cross-flow type for heat exchange between different media of which one is a gas G and the other is a fluid V. This plate heat exchanger could be square-formed as shown in the drawings or rectangular. If the plate heat exchanger is rectangular fluid could flow through a essential longer path than the gas, whereby the function of the plate heat exchanger could be maximised. This plate heat exchanger comprises a stack 1 of plates under which there may be located a bottom plate 2 and on top of which there may be located a top plate 3.

The stack 1 of plates includes plates 8*a*, 8*b* which together define through-flow gaps 9 and 10 of which every second through-flow gap 9 extends through the plate heat exchanger and is adapted to let through gas G. The remaining through-flow gaps 10 extend crosswise relative to the through-flow gaps 9 and are adapted to permit passage of fluid V. Each plate 8*a*, 8*b* respectively have elongated corrugating ridges 15 which form elongated through-flow channels 16*a*, 16*b* for through-flow of one medium G or V at one side of one plate 8*a*, 8*b* respectively and for through-flow of the other medium V or G at the other side of said plate 8*a*, 8*b* respectively.

The corrugating ridges 15 of each first plates 8*a* are connected with the corrugating ridges 15 of the second plate 8*b*

Each plate 8*a*, 8*b* respectively is provided with opposing edge potions 11, 12. The plates 8*a* are additionally provided with opposing edge portions 13, 13*a*, while the plates 8*b* are additionally provides with edge portions 14, 14*a*.

The plates 8*a*, 8*b* in the stack 1 are positioned such that their corrugating ridges 15 cross each other.

The first and the second plate 8*a*, 8*b* have two first opposing edge portions 11, 12 which at two first opposing sides of the stack 1 define inlet and outlet gas 17, 18 through which gas G can flow into and out from the through-flow gaps 9 for gas G. The plate 8*a* has two opposing edge portions 13, 13*a* and the plate 8*b* two opposing edge portions 14, 14*a*. At two other opposing sides of the stack 1, the lastmentioned edge portions forms fluid transfer chambers 21*a*, 21*b* through which fluid V could flow into and out from through-flow channals 16*b* for fluid V.

The corrugating ridges 15 of each plate 8*a*, 8*b* are connected to each other. Each plate 8*a*, 8*b* respectively defines a partition wall between the through-flow gaps 9 for gas G and the through-flow gaps 10 for fluid V.

Each first and second plate 8*a*, 8*b* respectively is provided with at least one fluid transfer opening 13*c*, 14*c* respectively which are positioned in each of the edge portions 13, 13*a* and 14, 14*a* respectively. These fluid transfer openings 13*c*, 14*c* are connecting fluid transfer chambers 21*a* at one side of the stack 1 with each other so that fluid could flow from at least one fluid inlet D into and through said fluid transfer chambers 21*a* at one side of the stack 1 into the through-flow gaps 10 and through these gaps in a direction R to fluid transfer chambers 21*b* at the opposite side of the stack 1.

The fluid transfer openings 13*c*, 14*c* are connecting the fluid transfer chambers 21*b* with each other so that fluid V could flow from the through-flow gaps 10 into the fluid transfer chambers 21*b* and through these chambers 21*b* out through a fluid outlet E.

The plates 8*a*, 8*b* are positioned such that the edge portions 13, 13*a* of the first plate 8*a* is tight connected with the edge portions 14, 14*a* of the other plate 8*b* and the fluid transfer openings 13*c*, 14*c* of these edge portions are also connected with each other.

The top plate 3 or another closing element is positioned at the end of the stack 1 with respect to the fluid inlet D and/or the fluid outlet E so that the fluid is circulating through the plate heat exchanger.

The edge portions 13, 13*a* and 14, 14*a* respectively of the plates 8*a*, 8*b* respectively are provided with end walls 13*d*, 13*e* and 14*d*, 14*e* respectively. These end walls are closing the fluid transfer chambers 21*a*, 21*b* respectively of opposite sides of the stack 1 and each end wall of a plate 8*a* is tight connected with an end wall of an adjacent plate 8*b*.

The corrugating ridges 15 of each plate 8*a* and 8*b* respectively, extend between two planes P1 and P2 so that outer portions 15*a* of every second corrugating ridge 15 lie in the first plane P1 and outer portions 15*a* of corrugating ridges 15 there between lie in the second plane P2. The outer portions 15*a* of the corrugating ridges 15 of one plates 8*a* are pointwise connected with the outer portions 15*a* of the corrugating ridges 15 of the other plates 8*b*.

The first opposing edge portions 11, 12 of each plate 8*a*, 8*b* are positioned in the first plane P1. The other opposing edge portions 13, 13*a* of a first plate 8*a* are positioned in the second plane P2 and the two other opposing edge portions 14, 14*a* of a second plate 8*b* are positioned in the second plane P2.

The distance between the planes P1 and P2 of the plate 8*a* is A and between the planes P1 and P2 is A1.

The first and second plates 8*a*, 8*b* are positioned relative each other such that the edge portions 11, 12 positioned in the first planes P1 are positioned in a distance of A+A1 and the edge potions 13, 13*a*, 14, 14*a* positioned in the other planes P2 are connected with each other.

The distance A between the planes P1, P2 of a first plate 8*a* could be the same as the distance A1 between the planes P1, P2 of a second plate 8*b* but the distances A, A1 could alternatively be different.

The end walls 13*d*, 13*e* of the plate 8*a* are positioned on the same side of the plane P2 as the corrugating ridges 15 but the end walls 14*d*, 14*e* and the corrugating ridges 15 of the plate 8*b* are positioned on different sides of the plane P2.

The end walls 13*d*, 13*e* of the plates 8*a* are connected with the end walls 14*d*, 14*e* of the plates 8*b*.

As shown in the figures, there are no separate fluid transfer chambers outside stack 1 but instead the plate 8*a*, 8*b* are forming such chambers 21*a*, 21*b*.

The first plates 8*a* of the stack may have an identical shape and the other plates 8*b* may also be identical. In addition, the first and second plates may have an identical shape with the exception that the end walls 13, 13*e* and 14*d*, 14*e* respectively are positioned in a different directions.

The angles $\alpha$ of the corrugating ridges relative to the inlet gaps 17 for fluid V, for which the heat exchange of the plate heat exchanger may be maximized, may be less than the angles $\beta$ of the corrugating ridges 15 relative to inlet gaps 17 for gas G for which the resistance of heat exchanger may be minimized.

The plates 8*a*, 8*b* are manufactured in one piece of a metallic material, their edge portions 11, 12, 13, 13*a*, 14 and 14*a*, their corrugating ridges 15 and their end walls 13*d*, 13*e*, 14*d* and 14*e* are attached to each other by soldering, e.g. vacuum soldering. The soldering can be carried through by applying a material suitable for soldering between the plates 8*a*, 8*b* and then place the plate heat exchanger in a heating device in which the soldering material is melted. When the plate heat exchanger is removed from the heating device and the melted soldering material has cooled down, the solder is finished and the plate heat exchanger is tight and rigid.

Finally, it could be mentioned that the embodiments of the plate heat exchanger described above may vary within the scope of the following claims.

What is claimed is:

1. Plate heat exchanger of cross-flow type for heat exchange between different media of which one is a gas and the other a fluid, wherein the plate heat exchanger comprises plates (8*a*, 8*b*) with elongated and in various alternating directions protruding corrugating ridges (15), wherein the plate heat exchanger has through-flow gaps (9) for a gas (G) and through-flow gaps (10) for a fluid (V), wherein the through-flow gaps (9, 10) extend crosswise relative to each other through the plate heat exchanger such that said gas (G) and fluid (V) flow crosswise relative to each other through said plate heat exchanger, wherein each plate (8*a* and 8*b* respectively) defines a partition wall between two different through-flow gaps (9, 10) for gas (G) and fluid (V) respectively such that heat transfer between said media gas (G) and fluid (V) respectively occurs through said plate (8*a* and 8*b* respectively), wherein the corrugating ridges (15) are positioned between two planes (P1, P2), wherein each plate (8*a*, 8*b*) has two opposing edge portions (11, 12) which are provided in one plane (P1) and two other opposing edge portions (13, 13*a* and 14, 14*a* respectively) which are provided with fluid transfer openings (13*c*, 14*c* respectively) and which are provided in the other plane (P2), wherein the fluid transfer openings (13*c*, 14*c* respectively) of the two other edge portions are provided for the transfer of fluid (V) between fluid transfer chambers (21*a*, 21*b*) which are formed by the plates (8*a*, 8*b*) and through which fluid (V) is transferred to and from the through-flow gaps (10) for fluid (V) and wherein the corrugating ridges (15) are located inclined or obliquely relative to said edge portions, characterized in that one plate (8*a*) of two adjacent plates (8*a*, 8*b*) at opposing edge portions (13, 13*a*) including fluid transfer openings (13*c*) is provided with end walls (13*d*, 13*e*), said end walls (13*d*, 13*e*) and the corrugating ridges (15) of said one plate (8*a*) are positioned relative to each other on the same side of a plane (P2) in which said edge protions (13, 13*a*) are provided, that another plate (8*b*) of said adjacent plates (8*a*, 8*b*) at opposing edge portions (14, 14*a*) including fluid transfer openings (14*c*) is provided with end walls (14*d*, 14*e*), said end walls (14*d*, 14*e*) and the corrugating ridges (15) of said other plate (8*b*) are positioned relative to each other on opposite sides of a plane (P2) in which said edge portions (13, 13*a*) are provided, that the adjacent plates (8*a*, 8*b*) are mounted relative to each other such that two edge portions (13, 13*a*) of one plate (8*a*) including fluid transfer openings (13*c*) and provided in one plane (P2) are joined together with two edge portions (14, 14*a*) of the other plate (8*b*) including fluid transfer openings (14*c*) and located in the same plane (P2), while two edge portions (11, 12) of said one plate (8*a*) provided in another plane (P1) are situated at a distance from two edge portions (11, 12) of said other plate (8*b*) provided in said another plane (P1), said two edge portions (11, 12) located at a distance from each other defining outlet and inlet gaps (17, 18) into and from a through-flow gap (9) for gas (G) defined between the plates (8*a*, 8*b*), said inlet and outlet gaps (17, 18) having substantially the same height (A+A1) as said through-flow gap (9) for gas (G), that the adjacent plates (8*a*, 8*b*) are mounted such that the corrugating ridges (15) inclined relative to edge portions (11–14), cross each other and are joined together, that the end walls (13*d*, 13*e*, 14*d*, 14*e*) of the adjacent plates (8*a*, 8*b*) are joined together and that the edge portions (11, 12, 13, 13*c*, 14, 14*c*), the corrugating ridges (15) and the end walls (13*d*, 13*e*, 14*d*, 14*e*) of two adjacent plates (8*a*, 8*b*) are joined together by means of soldering.

2. Plate heat exchanger according to claim 1, characterized in that first plates (8*a*) are identical and that second plates (8*b*) are identical.

3. Plate heat exchanger according to claim 1, characterized in that the fluid transfer chambers (21*a*, 21*b*) are formed by the plates (8*a*, 8*b*) instead of separate fluid transfer chambers positioned and outside the plates (8*a*, 8*b*).

4. Plate heat exchanger according to claim 1, characterized in that the first and second plates (8*a*, 8*b*) are identical except for different positions of the end walls (13*d*, 13*e*).

5. Plate heat exchanger according to claim 1, characterized in that the angles (α) of the corrugating ridges (15) relative to edge portions (13, 13*a*) at fluid transfer chambers (21*a*, 21*b*) for fluid (V) for which the heat transfer in the plate heat exchanger shall be maximized, are less than the angles (β) of the corrugating ridges (15) relative to edge portions (11) at inlet gaps (17) for the gas (G) for which the resistance in the plate heat exchanger shall be minimized.

6. Plate heat exchanger according to claim 1, characterized in that the corrugating ridges (15) engage each other pointwise and are joined together at the engagement or contact points.

7. Plate heat exchanger according to claim 1, characterized in that at least one closing element, e.g. a top plate (3), is provided for closing the fluid transfer openings (13*c* or 14*c*) of such a plate (8*a* or 8*b*) which is positioned at one end of the plate heat exchanger.

8. Plate heat exchanger according to claim 1, characterized in that the edge portions (11, 12, 13, 13*a*, 14, 14*a*) of the plates (8*a*, 8*b*) are plane.

9. Plate heat exchanger according to claim 2 characterized in that the fluid transfer chambers (21*a*, 21*b*) are formed by the plates (8*a*, 8*b*) instead of separate and outside the plates (8*a*, 8*b*) positioned fluid transfer chambers.

10. Plate heat exchanger according to claim 3 characterized in that the first and second plates (8*a*, 8*b*) are identical except of different positions of the end walls (13*d*, 13*e*).

11. Plate heat exchanger according to claim 2 characterized in that the angles (α) of the corrugating ridges (15) relative to edge portions (13, 13*a*) at fluid transfer chambers (21*a*, 21*b*) for fluid (V) for which the heat transfer in the plate heat exchanger shall be maximized, are less than the angles (β) of the corrugating ridges (15) relative to edge portions (11) at inlet gaps (17) for the gas (G) for which the resistance in the plate heat exchanger shall be minimized.

12. Plate heat exchanger according to claim 3 characterized in that the angles (α) of the corrugating ridges (15) relative to edge portions (13, 13*a*) at fluid transfer chambers (21*a*, 21*b*) for fluid (V) for which the heat transfer in the plate heat exchanger shall be maximized, are less than the angles (β) of the corrugating ridges (15) relative to edge portions (11) at inlet gaps (17) for the gas (G) for which the resistance in the plate heat exchanger shall be minimized.

13. Plate heat exchanger according to claim 4 characterized in that the angles (α) of the corrugating ridges (15) relative to edge portions (13, 13*a*) at fluid transfer chambers (21*a*, 21*b*) for fluid (V) for which the heat transfer in the plate heat exchanger shall be maximized, are less than the angles (β) of the corrugating ridges (15) relative to edge portions (11) at inlet gaps (17) for the gas (G) for which the resistance in the plate heat exchanger shall be minimized.

14. Plate heat exchanger according to claim 2 characterized in that the corrugating ridges (15) engage each other pointwise and are joined together at the engagement or contact points.

15. Plate heat exchanger according to claim 3 characterized in that the corrugating ridges (15) engage each other pointwise and are joined together at the engagement or contact points.

16. Plate heat exchanger according to claim 4 characterized in that the corrugating ridges (15) engage each other pointwise and are joined together at the engagement or contact points.

17. Plate heat exchanger according to claim 5 characterized in that the corrugating ridges (15) engage each other pointwise and are joined together at the engagement or contact points.

18. Plate heat exchanger according to claim 2 characterized in that at least one closing element, e.g. a top plate (3), is provided for closing the fluid transfer openings (13*c* or 14*c*) of such a plate (8*a* or 8*b*) which is positioned at one end of the plate heat exchanger.

19. Plate heat exchanger according to claim 3 characterized in that at least one closing element, e.g. a top plate (3), is provided for closing the fluid transfer openings (13*c* or 14*c*) of such a plate (8*a* or 8*b*) which is positioned at one end of the plate heat exchanger.

20. Plate heat exchanger according to claim 4 characterized in that at least one closing element, e.g. a top plate (3), is provided for closing the fluid transfer openings (13*c* or 14*c*) of such a plate (8*a* or 8*b*) which is positioned at one end of the plate heat exchanger.

21. Plate heat exchanger according to claim 5 characterized in that at least one closing element, e.g. a top plate (3), is provided for closing the fluid transfer openings (13*c* or 14*c*) of such a plate (8*a* or 8*b*) which is positioned at one end of the plate heat exchanger.

22. Plate heat exchanger according to claim 6 characterized in that at least one closing element, e.g. a top plate (3), is provided for closing the fluid transfer openings (13*c* or 14*c*) of such a plate (8*a* or 8*b*) which is positioned at one end of the plate heat exchanger.

23. Plate heat exchanger according to claim 2 characterized in that the edge portions (11, 12, 13, 13*a*, 14, 14*a*) of the plates (8*a*, 8*b*) are planar.

24. Plate heat exchanger according to claim 3 characterized in that the edge portions (11, 12, 13, 13*a*, 14, 14*a*) of the plates (8*a*, 8*b*) are planar.

25. Plate heat exchanger according to claim 4 characterized in that the edge portions (11, 12, 13, 13*a*, 14, 14*a*) of the plates (8*a*, 8*b* ) are planar.

26. Plate heat exchanger according to claim 5 characterized in that the edge portions (11, 12, 13, 13*a*, 14, 14*a*) of the plates (8*a*, 8*b* ) are planar.

27. Plate heat exchanger according to claim 6 characterized in that the edge portions (11, 12, 13, 13*a*, 14, 14*a*) of the plates (8*a*, 8*b* ) are planar.

28. Plate heat exchanger according to claim 7 characterized in that the edge portions (11, 12, 13, 13*a*, 14, 14*a*) of the plates (8*a*, 8*b* ) are planar.

* * * * *